US005208430A

United States Patent [19]

Ludzia

[11] Patent Number: 5,208,430

[45] Date of Patent: May 4, 1993

[54] POSITION RESPONSIVE SWITCH

[75] Inventor: Leo F. Ludzia, Chicago, Ill.

[73] Assignee: Christiana Industries Corporation, Chicago, Ill.

[21] Appl. No.: 907,266

[22] Filed: Jul. 1, 1992

[51] Int. Cl.[5] ..... H01H 35/02

[52] U.S. Cl. ..... 200/61.52; 200/61.83

[58] Field of Search ..... 200/61.45 R-61.53, 200/61.62-61.83, DIG. 29

[56] References Cited

U.S. PATENT DOCUMENTS

| | | | |
|---|---|---|---|
| 2,950,365 | 8/1960 | Bolstad | 200/61.52 |
| 3,729,602 | 4/1973 | Myers | 200/61.52 |
| 3,733,447 | 5/1973 | Schneider, Jr. | 200/61.52 |
| 3,823,285 | 7/1974 | Dwyer | 200/DIG. 29 |
| 4,042,796 | 8/1977 | Zink | 200/61.45 R |
| 4,310,729 | 1/1982 | Resener | 200/11 K X |
| 4,467,154 | 8/1984 | Hill | 200/61.45 R |
| 4,513,183 | 4/1985 | Hill | 200/61.45 R |
| 4,956,629 | 9/1990 | Chen | 340/429 |
| 5,095,409 | 3/1992 | Dematteo et al. | 200/315 X |

*Primary Examiner*—J. R. Scott

*Attorney, Agent, or Firm*—Jon Carl Gealow; James M. Wetzel

[57] ABSTRACT

A position responsive switch having a ball received within a hollow cylindrical conductor. Depended upon the position of the switch, the ball may contact only the hollow cylindrical conductor or it may also contact a second conductor to complete a circuit between the two conductors. The cylindrical conductor and ball are enclosed in a two-part insulating housing, including a hollow member having one closed end, and a cap for closing the open end of the hollow member. Electrical leads are connected to the two conductors through the closed end of the hollow housing member.

19 Claims, 1 Drawing Sheet

Fig. 2
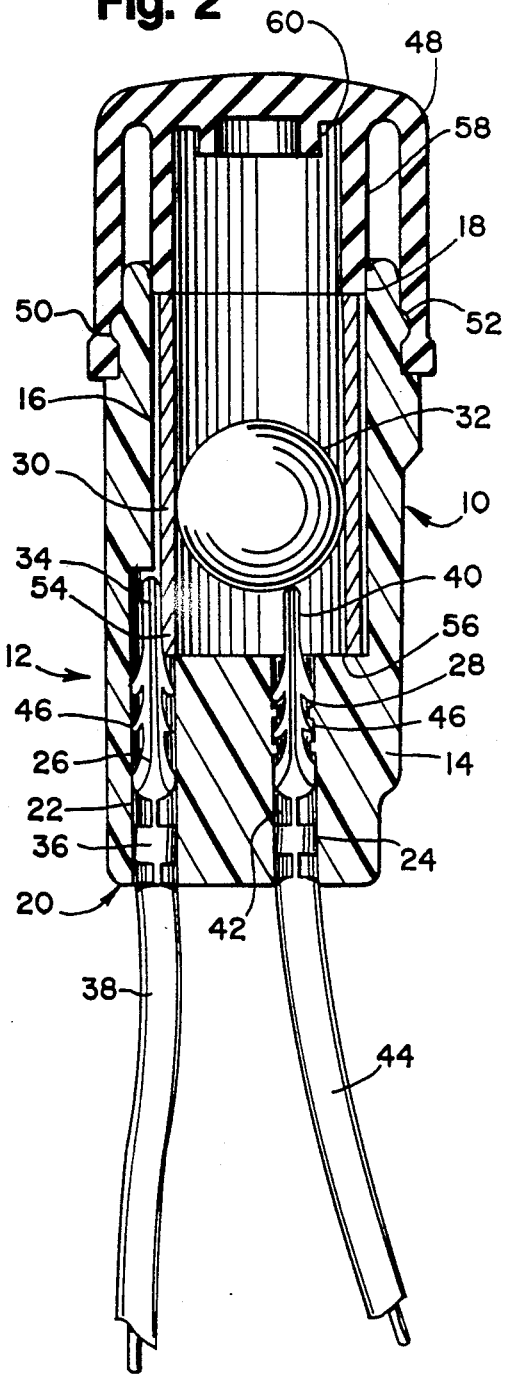
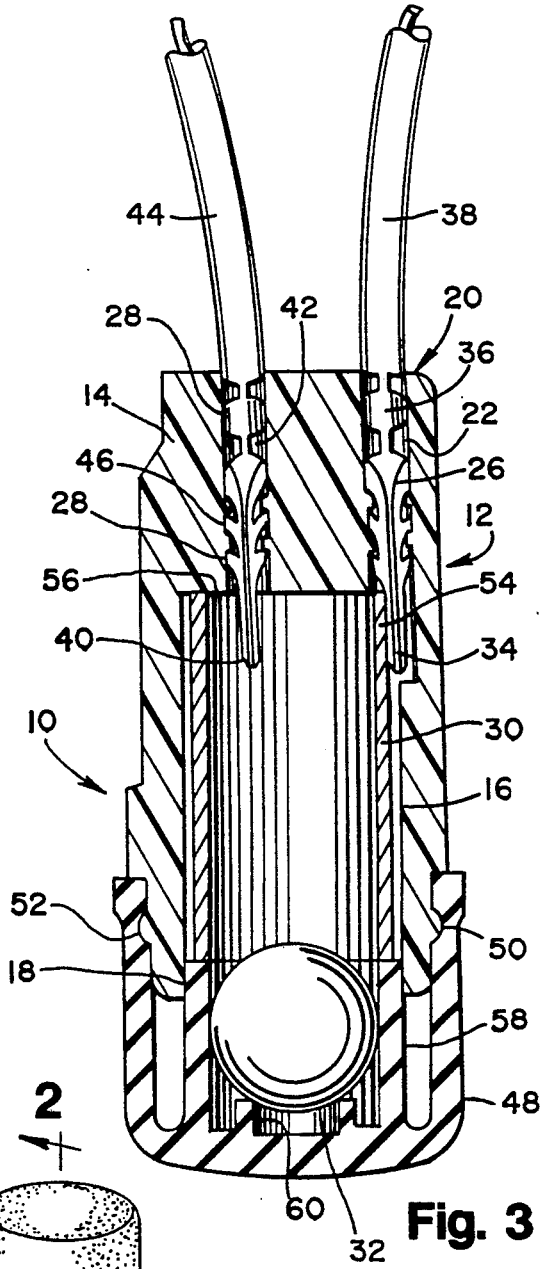
Fig. 3
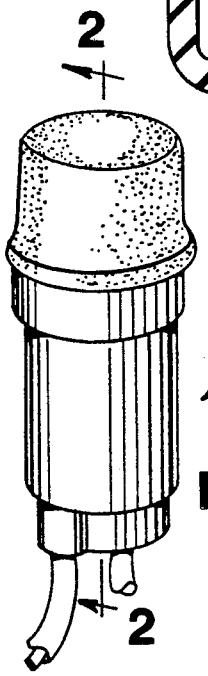
Fig. 1

POSITION RESPONSIVE SWITCH

BACKGROUND OF THE INVENTION

1. Field of the Invention

This invention relates to a position responsive electrical switch, which includes a member which under the influence of gravity changes its position to open and close the contacts of the switch as the position of the switch is changed. The switch may be used in place of mercury switches which have been mounted on automobile hoods or trunk lids to complete or break a circuit to an electrical light when the hood or trunk lid is opened or closed respectively.

2. Description of Related Art Including Information Disclosed under Secs. 1.97-1.99

In the past, the position sensitive switches utilized to turn on and turn off the light upon the opening or closing of the hood or trunk lid of an automobile have included a quantity of mercury as the gravity responsive movable conductor. Wherein mercury is now considered a hazardous material, it is desirable to avoid its use, particularly in situations where it may be released into the environment without proper disposal. When mercury containing switches are used in an automobile, the probabilities of improper disposal of the mercury are quite high, both when it is necessary to replace a failed switch and when the automobile is scrapped. Even in a business directed to disposal of a large number of scrapped automobiles, the quantity of mercury involved does not make it economically attractive to separately process the small quantity of mercury found in the switches.

It is therefore an object of this invention to provide a position responsive switch which does not include mercury as one of its materials. It is a further object of this invention to provide a switch which is readily assembled from a minimum number of components, and which is reliable in its operation. It is a further object of this invention to provide a switch, the external contacts of which are positioned so as to be readily connected in a circuit to be controlled by the switch.

While the applicant's switch offers features not found in the prior art, others have recognized the environmental problem presented by mercury switches and have also provided gravity actuated switches wherein a conductive ball is mounted in a metal enclosure such that, in a predetermined position of the switch, the ball is engageable with an electrical contact to complete a circuit between the metal enclosure and the electrical contact. Switches which have been provided in the past are represented in the disclosures of the following U.S. patents:

| U.S. Pat. No. | INVENTOR | ISSUE DATE |
|---|---|---|
| 3,729,602 | Myers | 04/24/73 |
| 3,733,447 | Schneider, Jr. | 05/15/73 |
| 4,042,796 | Zink | 08/16/77 |
| 4,467,154 | Hill | 08/21/84 |
| 4,513,183 | Hill | 04/23/85 |
| 4,956,629 | Chen | 09/11/90 |

The Zink, the two Hill and the Chen patents all depict switches in which a conductive metal ball is placed within a conductive cylindrical housing and is movable from positions where it only contacts the metal sleeve, to a position wherein it not only contacts the metal sleeve, but also a conductive member centrally located with respect to the sleeve. However, the constructions of the switches in the above-mentioned patents are quite different from that of this invention. For instance, the Hill patents do not provide male or female connectors which are readily connected to mating connectors such as would be secured to the end of flexible conductors to which the switch is to be connected. Rather, as shown in FIG. 1 of the patent, a specially designed socket must be provided for the switch. The Zink patent reveals a switch structure considerably different from that of this invention. The contacts of the switch, which are normally closed, provide an indication of vibrations of the switch by momentarily opening the contacts of the switch.

The construction of the Chen switch is considerably more complex than that of the applicant's invention wherein it involves the assembly of a considerably greater number of components and the deformation, of both a rivet and a flange on a metallic housing. The Myers and the Schneider, Jr. patents are only included to show additional prior patents disclosing switches which include a ball as an actuating member.

SUMMARY OF THE INVENTION

Accordingly, it is an object of this invention to provide a gravity-actuated position responsive switch which is readily assembled from a minimum number of components without the need for specialized assembly tools.

In accordance with this invention, an insulating housing is provided having a cylindrical bore for receiving a hollow cylindrical conductive member. The housing has an open end and a closed end which is provided with a pair of apertures for receiving a pair of contacts. The contacts are provided with elongated tips. An edge of the elongated tip of one of the contacts engages the outer surface of the cylindrical conductive member. The tip of the other contact is positioned within the cylindrical conductive member such that it may be engaged by a spherical contact or ball placed within the cylindrical conductive member. A insulating cap is provided for closing the open end of the housing after the cylindrical conductive member and the ball are placed within the housing. Thus, to assemble the switch of this invention, it is only necessary to insert the two contacts, with conductive wires secured thereto, into the pair of apertures in the closed end of the housing, insert the cylindrical sleeve and ball into the open end of the housing and snap the insulating cover thereover. Such a simplified, yet most effectively constructed switch has not been seen in the prior art.

BRIEF DESCRIPTIONS OF THE DRAWINGS

FIG. 1 is a perspective view of the position responsive switch of this invention.

FIG. 2 is a cross-sectional view of the position responsive switch of this invention taken along the line 2—2 in FIG. 1 showing the switch in a first position as shown in FIG. 1.

FIG. 3 is a cross-sectional view of the position responsive switch of this invention taken along the line 2—2 in FIG. 1 showing the switch in a second position.

DETAILED DESCRIPTION OF THE PREFERRED EMBODIMENT

The position responsive switch 10 of this invention is readily assembled from a limited number of components. An insulating housing 12 includes a first portion 14 which is formed as a hollow sleeve with an open end and a closed end. The first portion 14 is provided with a cylindrical bore 16 which is open at end 18 and closed at end 20. The closed end 20 has a pair of apertures 22 and 24 formed therein for receiving electrically conductive members or contacts 26 and 28.

Received within the bore 16 is a first electrically conductive member 30 formed as a hollow sleeve. In a preferred embodiment, the hollow sleeve 30 is formed as a cylindrical steel tube having a palladium finish to prevent rusting and to provide a better electrical contact surface. Received within the sleeve 30 is a fourth electrically conductive member 32 in the form of a spherical ball. In a preferred embodiment, the spherical ball is made of steel and is also provided with a palladium coating to prevent rusting and to provide a better electrical contact surface.

The electrical contact 26 is provided with an elongated tip 34 which engages the outer surface of the sleeve 30 to make electrical contact therewith. Portion 36 of the contact 26 is a typical crimp connector for making connection to an insulated wire 38 which extends from the switch. The electrical contact 2 is also provided with an elongated tip 40 which is engageable by the ball 32. The other end of the contact 28 is provided with a typical crimp connector 42 for making connection to an insulated wire 44 which extends from the switch.

The switch is readily assembled by inserting the contacts 26 and 28 into the apertures 22 and 24 from the lower end as viewed in FIG. 1. Gripping fingers 46 are provided on the contacts 26 and 28, to prevent the withdrawal of the contacts once they are inserted into the first portion 14 of housing 12. With the contacts positioned in the apertures 22 and 24, the sleeve 30 may be pushed in from the open end of the first portion 14 of the housing to engage the elongated tip 34 of contact 26. With the ball 32 placed in the sleeve 30, a cap 48 formed of a resilient material is placed over the open end of the first portion 14 of housing 12 to complete the assembly of the switch. The housing portion 14 is provided with a circular rib 50 which is engaged in a groove 52 formed on the inner surface of the cap 48 for retaining the cap on the housing. In a preferred embodiment, the cap 48 is formed of a resilient rubber-like material, for instance injection grade PVC formulations such as SANTOPRENE made by Monsant or KRATON made by Shell Chemical Corporation. The resilient rubber-like material deadens the sound of the ball 32 moving within the sleeve 30.

As viewed in FIG. 1, the lower end 54 of the sleeve 30 engages an abutment 56 formed at the closed end of the bore 16, and an annular projection 58 on the inside surface of the cap 48 engages the upper end of the sleeve 30 to hold the sleeve in a fixed position within the housing. A second annular projection 60 is provided on the inner surface of the cap 18 to be engaged by the spherical contact 32 when it is in the second position shown in FIG. 3. The annular projection 60 being formed of the resilient rubber-like material to deaden the sound of the ball moving to the position shown in FIG. 3.

As shown in FIG. 3, the cap 48 is made of sufficient length, such that the ball 32 is essentially confined within the annular projection 58 when the switch is in the second position. When the switch is mounted on an automobile hood or trunk lid, it will be in the position shown in FIG. 3 during normal operation of the automobile. Since the ball is confined in the cap 48, which is formed of a resistent rubber-like material, rattles and noise from movement of the ball during operation of the automobile is suppressed.

With the switch shown in the position shown in FIGS. 1 and 2, an electrical circuit is established between the insulated conductors 38 and 44 through the contacts 26 and 28, the sleeve 30 and the spherical contact 32. When the switch is inverted to the position shown in FIG. 3, the ball no longer engages the tip 40 of the contact 28, such that the circuit between conductors 38 and 44 is opened.

Thus, in accordance with this invention, a position responsive switch is provided which is readily assembled from a minimum number of components without the need for assembly equipment. The assembled switch is provided with leads for ready connection to the circuit in which the switch is to be used.

It should be apparent to those skilled in the art that what has been described is considered at present to be the preferred embodiment of the position responsive switch of this invention. In accordance with the patent statutes, changes may be made in the position responsive switch as shown and described without actually departing from the true spirit and scope of this invention. The appended claims are intended to cover all such changes and modifications which fall in the true spirit and scope of this invention.

I claim:

1. A position responsive switch comprising, an insulating housing, said housing having a first portion including a hollow sleeve having a closed end and an open end, said closed end having at least two apertures formed therein, a second portion forming a cover to be secured on said open end, a first electrically conductive member formed as a hollow sleeve which is received within said hollow sleeve of said insulating housing, a second electrically conductive member received in one of said apertures, said second electrically conductive member having a first portion forming a first terminal for the switch, and a second portion extending into said hollow sleeve of said housing and engaging said first electrically conductive member to form an electrical connection therewith, a third electrically conductive member extending through another of said apertures, said third electrically conductive member having a first portion forming a second terminal for the switch, and a second portion extending within and spaced from said hollow sleeve of said first electrically conductive member, a fourth electrically conductive member, received and movable within said hollow sleeve of said first electrically conductive member, whereby in a first position of the position responsive switch said fourth electrically conductive member does not engage or make electrical contact with said third electrical conductive member, and in a second position of the position responsive switch said fourth electrical conductive member engages both said first electrically conductive member and said third electrically conductive member so as to complete an electrical circuit between said first portions of said second and third electrically conductive members.

2. The position responsive switch of claim 1, wherein said first portion of said insulating housing is provided with a first securing means at said open end and said second portion of said insulating housing is provided with a second securing means, said first and second securing means engaging each other to secure said second portion of said insulating housing to said first portion.

3. The position responsive switch of claim 2, wherein said first securing means is formed as a groove in the outer surface of said hollow sleeve of said first portion of said housing and said second securing means is a projection on said second portion of said housing which is engaged in said groove.

4. The position responsive switch of claim 2, wherein said hollow sleeve of said first portion of said housing has the same shape of said hollow sleeve of said first electrically conductive member.

5. The position responsive switch of claim 1, wherein said hollow sleeve of said first portion of said housing has the same shape of said hollow sleeve of said first electrically conductive member.

6. The position responsive switch of claim 5, wherein said hollow sleeves of said first portion of said housing and of said first conductive member are cylindrical.

7. The position responsive switch of claim 6, wherein said fourth electrically conductive member is essentially spherical.

8. The position responsive switch of claim 7, wherein said second portion of said third electrically conductive member is provided with a tip which is located within, but spaced from, said hollow sleeve of said first electrically conductive member and from the central axis of said cylindrical sleeve, such that in said second position said cylindrical ball rests on said tip and on said sleeve of said first electrically conductive member to form an electrical connection between said first and third electrically conductive members.

9. The position responsive switch of claim 1, wherein said second portion of said second electrically conductive member engages said first electrically conductive member with a spring force to make an electrical connection therewith.

10. The position responsive switch of claim 1, wherein said first and said fourth electrically conductive members are formed of steel, having a palladium coating thereon.

11. The position responsive switch of claim 1, wherein said second portion of said third electrically conductive member is provided with a tip which is located within but spaced from said hollow sleeve of said first electrically conductive member.

12. The position responsive switch of claim 1, wherein the switch is in the first position when said second portion of said insulating housing is positioned above said first portion of said insulating housing, and in the second position when said first portion of said housing is positioned above said second portion of said housing.

13. The position responsive switch of claim 1, wherein said second portion of said insulating housing is formed of a resilient material.

14. The position responsive switch of claim 13, wherein the inside bottom surface of said second portion of said insulating housing is provided with an inwardly extending annular projection which is engaged by said fourth electrically conductive member when said position responsive switch is moved to the second position, thereby deadening the sound of said fourth electrically conductive member moving to said second position.

15. The position responsive switch of claim 13, wherein said resilient material is SANTOPRENE.

16. The position responsive switch of claim 13, wherein said resilient material is KRATON.

17. The position responsive switch of claim 13, wherein said second portion of said insulating housing is formed as a cylindrical cup, said cylindrical cup forming an extension of said hollow sleeve of said first electrical conductive member, said electrical conductive member being essentially confined within said cylindrical cup when said switch is in the second position, whereby rattles and noise from vibration of said switch when in said second position is deadened.

18. The position responsive switch of claim 17, wherein said hollow sleeves of said first portion of said housing and of said first conductive member are cylindrical.

19. The position responsive switch of claim 18, wherein said second portion of said insulating housing is formed as a cylindrical cup, with said cylindrical cup having a sidewall and a base, a groove formed on the inner surface of said sidewall to provide said second securing means.

* * * * *